US010376936B2

(12) United States Patent
Singh

(10) Patent No.: US 10,376,936 B2
(45) Date of Patent: Aug. 13, 2019

(54) METHOD AND APPARATUS OF OPTIMIZING PERFORMANCE OF FUME HOODS

(71) Applicant: Gurmeet Singh, Stanhope, NJ (US)

(72) Inventor: Gurmeet Singh, Stanhope, NJ (US)

( * ) Notice: Subject to any disclaimer, the term of this patent is extended or adjusted under 35 U.S.C. 154(b) by 53 days.

(21) Appl. No.: 15/629,303

(22) Filed: Jun. 21, 2017

(65) Prior Publication Data

US 2017/0361365 A1 Dec. 21, 2017

Related U.S. Application Data

(60) Provisional application No. 62/352,958, filed on Jun. 21, 2016.

(51) Int. Cl.

| | |
|---|---|
| ***B01L 1/04*** | (2006.01) |
| ***B08B 15/02*** | (2006.01) |
| ***B01L 1/00*** | (2006.01) |

(52) U.S. Cl.

CPC ..... *B08B 15/023* (2013.01); *B01L 1/00* (2013.01); *B01L 1/04* (2013.01); *B01L 2200/082* (2013.01); *B01L 2200/146* (2013.01); *B01L 2400/082* (2013.01)

(58) Field of Classification Search

CPC ..... A62C 2/16; B08B 15/023; B01L 1/04; B01L 1/00; B01L 2400/082; B01L 2200/146; B01L 2200/082

USPC ..... 454/54, 49, 56, 57, 58, 59, 60, 63, 64, 454/65, 67

See application file for complete search history.

(56) References Cited

U.S. PATENT DOCUMENTS

| | | | | |
|---|---|---|---|---|
| 3,000,292 A * | 9/1961 | Wojan | B08B 15/023 | 454/59 |
| 3,318,227 A * | 5/1967 | Nelson | B08B 15/023 | 454/59 |
| 3,340,788 A * | 9/1967 | Landingham | B08B 15/023 | 454/59 |
| 3,747,505 A * | 7/1973 | Turko | B08B 15/023 | 454/59 |
| 3,897,721 A * | 8/1975 | Fuhst | B08B 15/023 | 454/59 |
| 4,031,819 A * | 6/1977 | Applewhite | B08B 15/02 | 266/158 |

(Continued)

*Primary Examiner* — Steven B McAllister
*Assistant Examiner* — Samantha A Probst
(74) *Attorney, Agent, or Firm* — Walter J. Tencza, Jr.

(57) ABSTRACT

An apparatus including a sensor configured to sense total pressure within an inner chamber of a housing, and to sense differential pressure between the inner chamber of the housing and work area outside of the housing; a computer processor configured to receive signals from the sensor based on the total pressure and the differential pressure; and wherein the computer processor controls the rate at which the flapper oscillates based on the total pressure signal from the sensor, to thereby control the direction of flow of air from the inner chamber of the housing through the plurality of openings of the blade, through the plurality of openings of the teeth, for optimum containment with ultra stable vortex inside the chamber; and controls the rate at which exhaust damper modulates based on differential pressure signal to maintain constant face velocity at the apparatus user opening and out an exhaust opening of the housing.

7 Claims, 8 Drawing Sheets

(56) References Cited

U.S. PATENT DOCUMENTS 4,098,174 A * 7/1978 Landy ..... B08B 15/023 454/57
4,177,718 A * 12/1979 Grow ..... B08B 15/023 422/567
4,230,471 A * 10/1980 Levecque ..... C03B 37/06 264/12
4,534,281 A * 8/1985 Parks ..... B08B 15/023 454/59
4,553,475 A * 11/1985 Saunders ..... B08B 15/023 454/57
4,617,805 A * 10/1986 Ikemura ..... E06B 7/10 165/53
5,092,227 A * 3/1992 Ahmed ..... B08B 15/023 454/340
5,117,746 A * 6/1992 Sharp ..... F24C 15/2021 454/61
5,251,608 A * 10/1993 Cote ..... F24C 15/2028 126/299 D
5,338,248 A * 8/1994 Sumrack ..... B08B 15/023 204/270
5,347,754 A * 9/1994 Jacob ..... B08B 15/023 454/61
5,470,275 A * 11/1995 Jacob ..... B08B 15/023 454/59
5,697,838 A 12/1997 Morris
5,718,626 A * 2/1998 Rindoks ..... B08B 15/023 454/56
5,882,254 A * 3/1999 Jacob ..... B08B 15/023 454/61
6,089,970 A * 7/2000 Feustel ..... B08B 15/023 454/57
6,428,408 B1 * 8/2002 Bell ..... B01L 1/50 454/56
6,814,658 B1 * 11/2004 Rindoks ..... E05D 13/14 454/56
7,318,771 B2 * 1/2008 Huang ..... B08B 15/023 454/61
7,470,176 B2 12/2008 Morris et al.
9,248,481 B1 * 2/2016 Soto ..... B09B 5/00
2003/0027513 A1 * 2/2003 Bastian ..... B08B 15/023 454/56
2006/0079164 A1 * 4/2006 DeCastro ..... B01L 1/04 454/56
2006/0154590 A1 * 7/2006 Kanaya ..... F24F 7/06 454/56
2007/0042696 A1 * 2/2007 Casey ..... B08B 15/00 454/49
2007/0087677 A1 * 4/2007 Morris ..... B08B 15/023 454/61
2008/0108290 A1 * 5/2008 Zeigler ..... B08B 15/023 454/56
2008/0146133 A1 * 6/2008 Behrens ..... F24C 15/20 454/49
2009/0032011 A1 * 2/2009 Livchak ..... F24C 15/20 126/299 D
2009/0191803 A1 * 7/2009 Barrette ..... B08B 15/02 454/56
2011/0117828 A1 * 5/2011 Huang ..... B01L 1/50 454/65
2012/0276830 A1 * 11/2012 Huang ..... F24F 9/00 454/49
2012/0322353 A1 * 12/2012 Christopherson ..... F24F 7/00 454/56
2013/0074261 A1 * 3/2013 Hallman ..... A61G 13/0027 5/600
2013/0090049 A1 * 4/2013 Meisenzahl ..... B08B 15/023 454/56
2013/0149947 A1 * 6/2013 Bagwell ..... F24C 15/20 454/49
2014/0080396 A1 * 3/2014 Charles ..... B08B 15/023 454/61
2014/0092239 A1 * 4/2014 Pelczynski ..... B08B 15/023 348/135
2014/0120819 A1 * 5/2014 Stakutis ..... F24F 3/1607 454/56
2014/0211411 A1 * 7/2014 Slaby ..... H05K 7/20745 361/679.46
2015/0079890 A1 * 3/2015 Stutzman ..... B01D 46/10 454/49
2015/0368961 A1 * 12/2015 Horn ..... E06B 7/10 454/211
2017/0354998 A1 * 12/2017 Smith ..... B08B 15/023
2017/0361365 A1 * 12/2017 Singh ..... B08B 15/023

* cited by examiner

METHOD AND APPARATUS OF OPTIMIZING PERFORMANCE OF FUME HOODS

CROSS REFERENCE TO RELATED APPLICATION(S)

This application claims the priority of U.S. provisional patent application Ser. No. 62/352,958, filed on Jun. 21, 2016, titled "Method to Optimize Performance of Existing and New Fume Hoods" inventor and applicant Gurmeet Singh.

FIELD OF THE INVENTION

The present invention relates to fume hoods.

BACKGROUND OF THE INVENTION

A fume hood may be generally described as a four sided ventilated enclosed workspace intended to capture or contain exhaust fumes, vapors, and particulate matter generated inside the enclosure thru a duct system with exhaust fan to atmosphere. The purpose of a fume hood is to draw fumes and other airborne matter generated within a work chamber away from a worker, so that inhalation of contaminants is minimized. The concentration of contaminants to which a worker is exposed should be kept as low as possible and should never exceed permissible exposure limits (PELs).

Typically, fume hoods in laboratory operate twenty-four hours a day and exhaust conditioned make up air from the room thru its window openings or bypass openings to the atmosphere. Lower energy consumption has triggered several known methods and apparatus for fume hoods with emphasis on making a stronger vortex formation inside a fume hood chamber or restricting face openings. Some known fume hoods have tried to address the vortex stability inside a fume hood chamber by modulating baffles or modulating a damper behind a baffle. Since the mechanism is hidden and inside the baffle conduit or baffle chamber, it is difficult to monitor any malfunction or repair any defects without decontaminating the entire fume hood and disassembling its components.

In general, known fume hoods are designed either for Variable Air Volume (VAV) or Constant Air Volume (CAV). Known VAV fume hoods maintain constant face velocity at a face opening by varying exhaust air volume with a modulated damper whereas known CAV fume hoods maintain constant exhaust air volume with fixed position or a pressure independent CAV damper and varying face velocity based on a face opening.

Nearly all known fume hoods provide vertical or combination (vertical and horizontal) sashes with counter balance weight, pulley, and cable mechanism. Over time, the vertical sash movement tends to wear out and makes it inoperable. When the sash counter balance weight is at the back of the fume hood, normally it has to be brought out of its place for repair that involves huge expense and down time to remove all the utilities and duct work.

Counter balance weight for the sashes along with associated parts accounts for 20% to 30% of the total weight depending on the liner material which makes it challenging to transport and install the fume hood in one piece.

SUMMARY OF THE INVENTION

In at least one embodiment an apparatus is provided comprising a housing having an inner chamber; and a first window device, including a first windowpane and a first window frame. The first window device may be connected to the housing, so that the first window device can be placed in a first state or a second state; wherein in the first state, the first window device covers a window opening in the housing, and in the second state, the first window device does not cover the window opening in the housing; and wherein the window opening in the housing leads to the inner chamber of the housing. The apparatus may further include an air device fixed to the housing, wherein the air device has an opening, which permits air to go through the opening of the air device, into the housing, and into the inner chamber of the housing.

In at least one embodiment the housing may have a exhaust opening at the top of the housing and the apparatus may be further comprised of a flapper including a blade and teeth, each having a plurality of further openings; and wherein the flapper is configured so that it can pivot and air can pass through the plurality of further openings of the blade and teeth, and thereafter pass through the exhaust opening at the top of the housing.

In at least one embodiment an apparatus is provided including a sensor configured to sense total pressure within an inner chamber of a housing, a computer processor which is configured to receive a signal from the sensor based on the total pressure; and a flapper fixed adjacent to an exhaust opening of the housing, wherein the flapper has a blade having a plurality of openings, and teeth having a plurality of openings; and wherein the computer processor controls the rate at which the flapper oscillates based on the signal from the sensor, to thereby control the direction of flow of air from the inner chamber of the housing through the plurality of openings of the blade, through the plurality of openings of the teeth, and out the exhaust opening of the housing. The apparatus may further include turning vanes fixed within the housing, which directs air flow within the housing to make a stronger vortex inside the chamber.

In at least one embodiment an apparatus is provided including a sensor configured to sense differential pressure between the inner chamber of the housing and work area outside of the housing; a computer processor which is configured to receive a signal from the sensor based on the differential pressure; and a damper fixed adjacent to an exhaust opening at the flapper of the housing, wherein the damper modulates to maintain constant face velocity at the window opening.

One or more embodiments of the present invention provide an ultra stable vortex for improved containment at low airflow with multiple turning vanes within a fume hood chamber, multi-functional airfoil, and automated air-straightening air-guiding flapper.

One or more embodiments of the present invention eliminate a hard to maintain counter weight balancing system for a vertical sash opening. The window system operates by sliding windowpanes horizontal or swings open as bi-fold and up/down vertical windowpane thus providing the ability to have full open sash for loading and unloading. It also provides a triple layer of glass for worker safety.

One or more embodiments of the present invention convert an existing known fume hood to an ultra stable vortex high performance low airflow fume hood with installation of multiple turning vanes, automated air-straightening air-guiding flapper, and a window system which provides full protection and provides full sash opening for loading and unloading.

One or more embodiments of the present invention are suitable for both VAV and CAV applications.

One or more embodiments of the present invention provide a window system with built-in airfoil that air washes inner surface of the window and work surface at window closing. It minimizes the hugging of contaminants along the interior wall of the window thereby reducing the chance of contaminants drag outside when the user opens windows.

One or more embodiments of the present invention reduce total weight by more than 20% with the elimination of sash counter balancing weight and associated parts.

One or more embodiments of the present invention are suitable for all sizes of fume hood including floor mounted or walk-in hoods.

DETAILED DESCRIPTION OF THE DRAWINGS

In the present application the following terms, in one or more embodiments are defined as follows:

Face Velocity: The average speed at which air passes perpendicular thru a fume hood opening (window or slots).

Turning Vanes: Angled smooth structure to change the direction of air in a plenum chamber in order to reduce resistance and turbulence.

Vortex: A mass of air that spins around very fast and pulls contaminants into its center.

Airfoil: A streamlined surface designed in such a way that air flowing around it produces useful motion.

Closed loop control: an automatic control method, apparatus and/or system in which an operation, process, or mechanism is regulated by feedback.

Microcomputer: a small computer and/or computer processor that contains a microprocessor as its central processor, and is programmed by computer software which may be stored in computer memory of the micro computer or computer processor.

Figure 1:
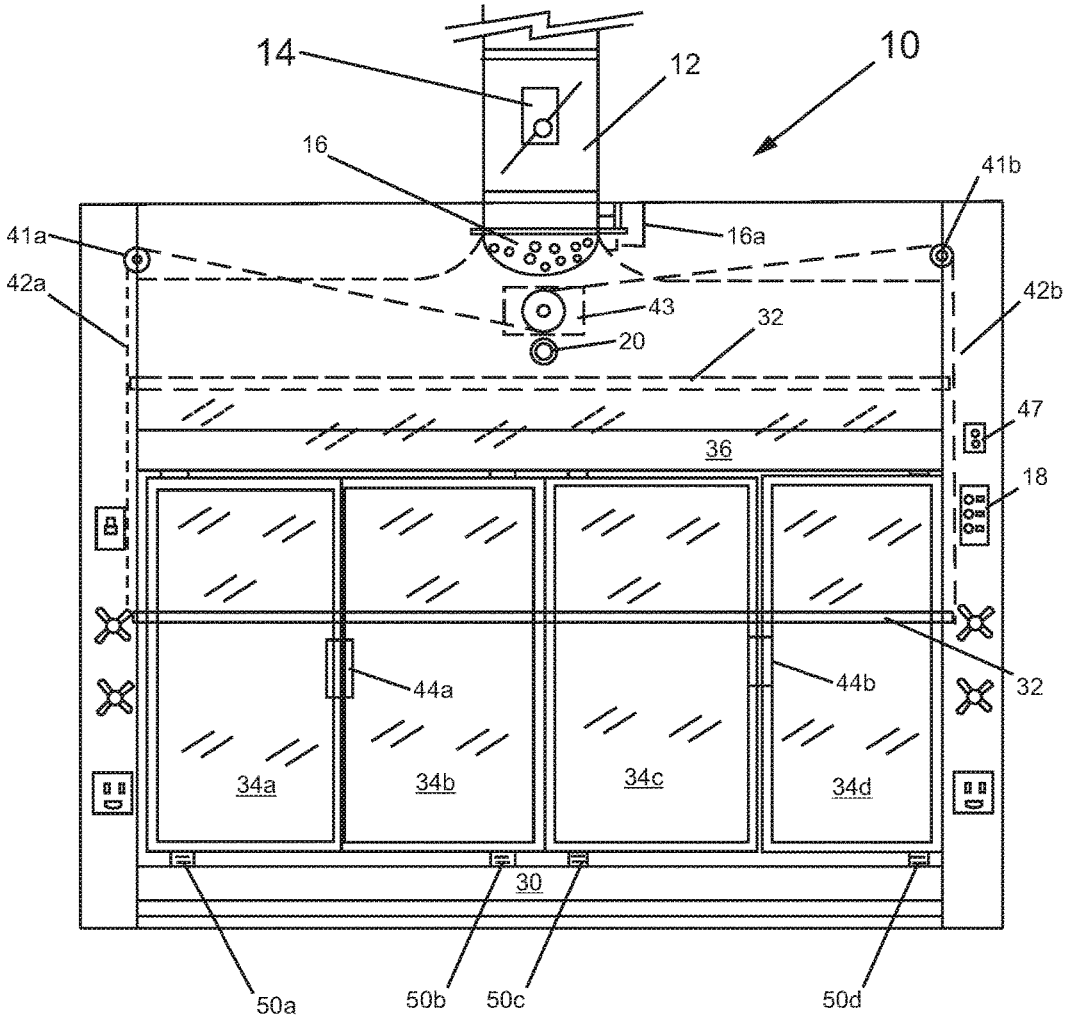
FIG. 1 illustrates a frontal view of a fume hood in accordance with an embodiment of the present invention.
Figure 2:
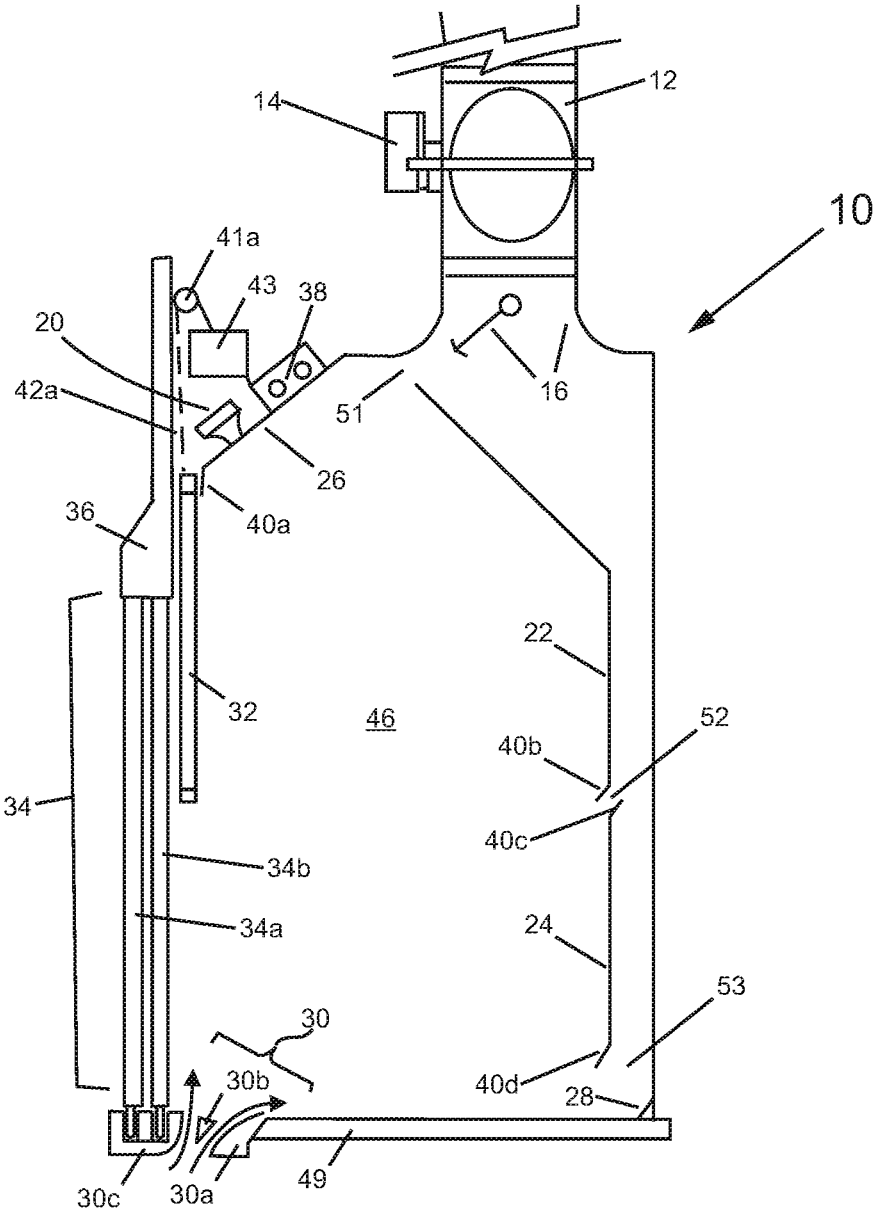
FIG. 2 depicts vertical cross sectional side view of fume hood of FIG. 1.

FIG. 1 illustrates a frontal simplified view of a fume hood 10 in accordance with an embodiment of the present invention, with one or more clear safety glass windows or windowpanes 34*a*, 34*b*, 34*c*, and 34*d* in a closed state. FIG. 2 depicts simplified vertical cross sectional side view of fume hood 10. Referring to FIGS. 1 and 2, the fume hood 10 includes a damper 12 and an actuator 14. The fume hood 10 further includes an air-straightening air-guiding flapper 16 and its actuator 16*a*, a microcomputer alarm and control unit 18, a dual function sensor 20, baffles 22 and 24, fume hood interior chamber 46, fixed turning vanes 40*a*, 40*b*, 40*c*, 40*d*, 26 and 28, baffle slots 51, 52 and 53, a window system built-in multi-functional air foil 30, sliding and swing open horizontal windowpanes 34*a*, 34*b*, 34*c*, and 34*d*, gliding tracks 36, pivot guide shoes 50*a*, 50*b*, 50*c* and 50*d*, removable hinge mechanisms 44*a* and 44*b*, a vertical clear safety glass windowpane 32, pulleys 41*a* and 41*b*, cords 42*a* and 42*b* shown by dashed lines actuator 43, vertical sash 32 up/down push button hand control 47, light 38, and work surface 49.

Figure 3:
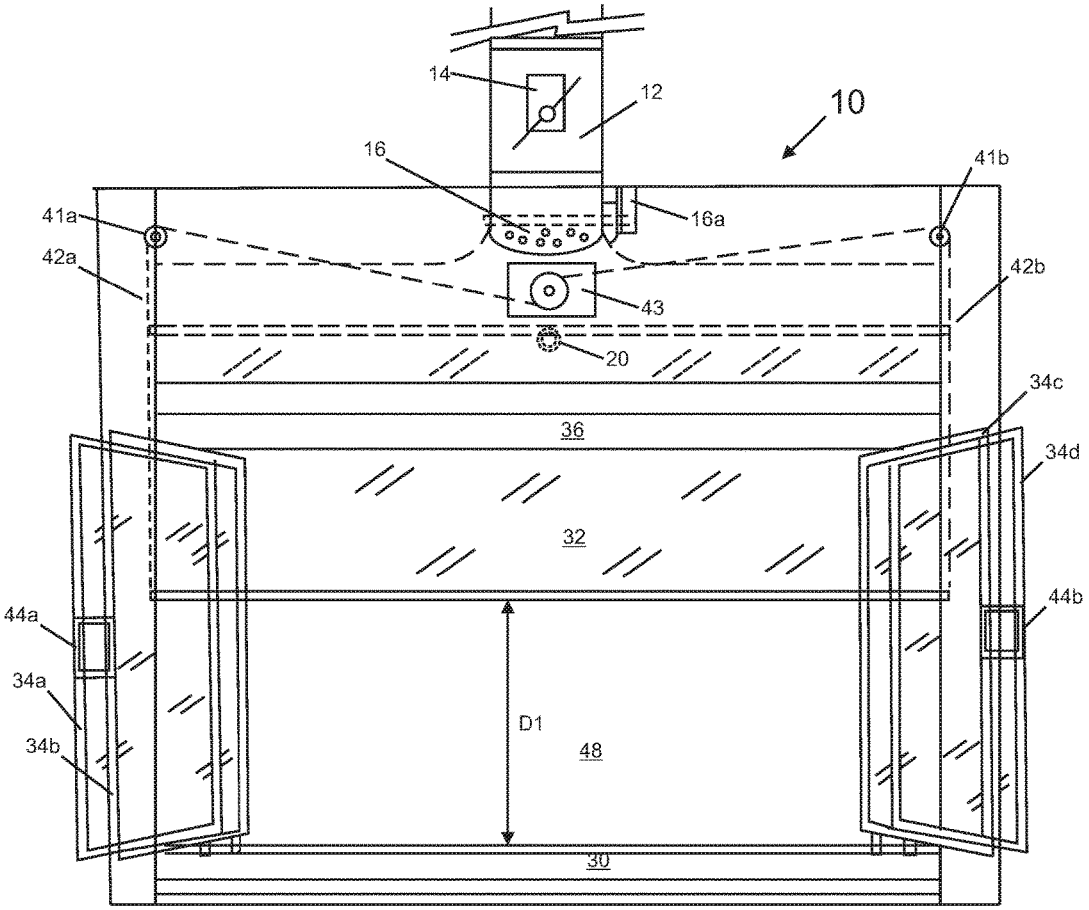
FIG. 3 illustrates a window system of the fume hood of FIG. 1.

FIG. 3 is a frontal simplified view of the fume hood 10 with one or more windows or windowpanes 34*a-d* in an open state. The windowpanes 34*c* and 34*d* have been slid to the right and the windowpanes 34*a* and 34*b* have been slid to the left from the state of FIG. 1 to the state of FIG. 3. Hinges 44*a* and 44*b* provide the ability to make the horizontal windowpanes bi-fold opening. Windowpane 32 opens fully vertically with manual lifting or electrical push button hand control 47 shown in FIG. 1

Figure 4:
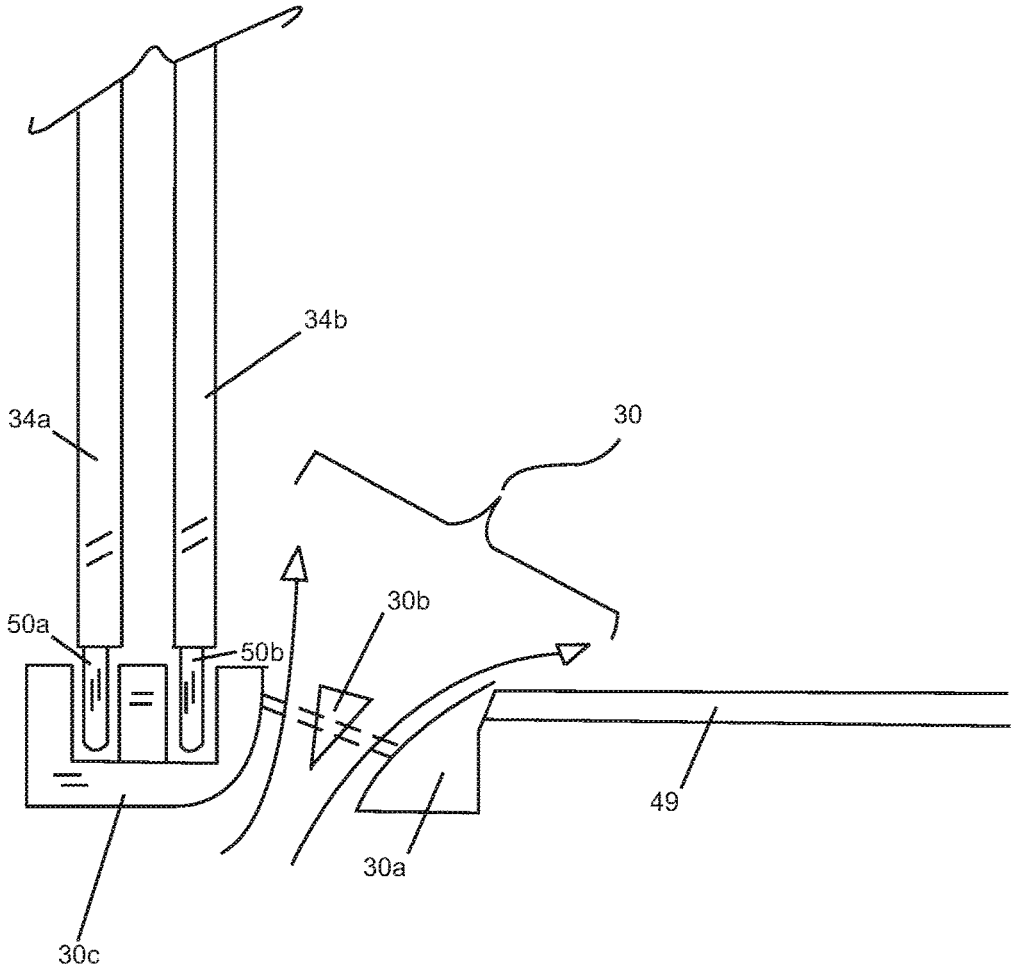
FIG. 4 depicts a built-in airfoil in a window system of the fume hood of FIG. 1.

FIG. 4 depicts the built-in airfoil 30 in the window system of the fume hood 10. Airfoil components 30*a*, 30*b* and 30*c* are curved to allow the air flow air-wash the inner window surface and work surface 49 in addition to guiding the airflow for stronger vortex formation inside the fume hood chamber. Airfoil component 30*a* may be utilized as drainage channel from work surface 49 spills.

Figure 5:
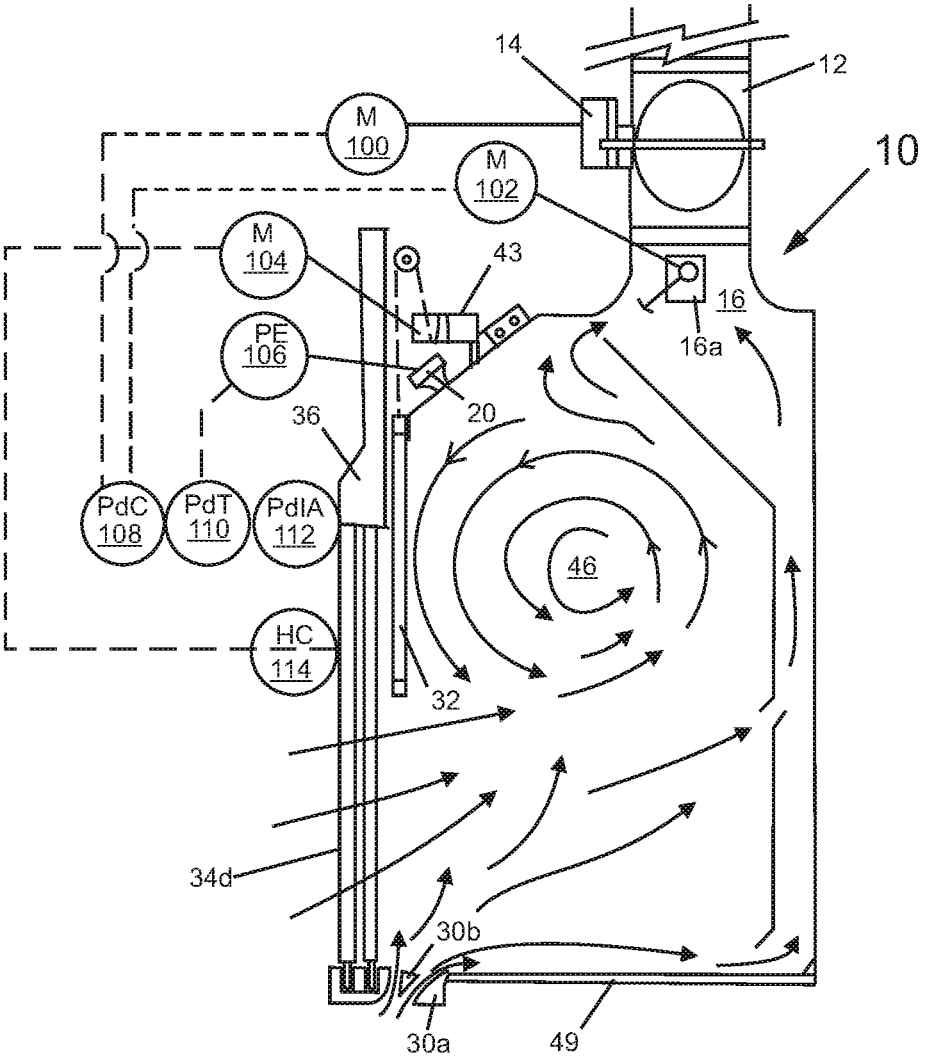
FIG. 5 illustrates a process and instrumentation diagram of fume hood alarm and control system.

FIG. 5 illustrates a process and instrumentation simplified diagram of a dual closed loop control system by the damper 12 with actuator 14 referred to as M 100, the air-straightening air-guiding flapper 16 with actuator 16*a* referred to M 102, a microcomputer alarm and control unit 18 with dual function pressure differential transmitter referred to PdT 110, a dual function pressure differential control referred to as PdC 108 and a dual function pressure differential indicating alarm referred to PdIA 112, the dual function pressure sensor 20 referred to PE 106 of the fume hood alarm and control system in accordance with an embodiment of the present invention. Vertical window 32 opening/closing or up/down by push button hand control 47 shown in FIG. 1 referred to HC 114 and actuator 43 referred to as M 104. The microcomputer alarm and control unit 18 may include a microprocessor and computer memory, in which is stored computer software for causing the microprocessor to control various components, and to execute various functions as explained in the present application.

FIG. 5 is a diagram used to describe various components and functions in accordance with one or more embodiments of the present invention. The actuator 16 is also shown by M 102. The actuator 14 is also shown by M 100. The actuator of component 43 is also shown by M 104. The sensor 20 is also shown by PE 106. The components 108, 110, and 112 can be described as functions performed by computer processor 18 as programmed by computer software stored in computer memory of the microcomputer or computer processor 18. The push button hand control 47 is shown by HC 114. The dashed lines from PdC 108 to actuators 14 (M 100) and 16 (M102) and are used to show control signals by the micro processor or microcomputer alarm and control circuit 18 of actuators 14 and 16. The dashed lines from PdT 110 to PE 106 is used to show sensor 20 provides the microcomputer 18 with data or signals, such as pressure differential between inside chamber 46 and the area immediately outside chamber 46. The dashed lines from HC 114 (hand control 47) to M 104, show that an individual can operate the vertical window 32 opening or closing by actuator 43 (M 104).

FIGS. 6-9 depict details of air-straightening air-guiding flapper 16. Half circle blade 16*c* and teeth 16*b* on both sides at the edge are perforated. The component 16*a* is an actuator to turn the blade shaft 17. The component 16*d* is shown as an oval bell mouth, whereas 16*e* is shown as round bell mouth.

Figure 6:
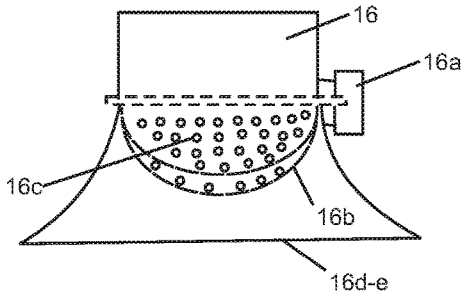
FIG. 6 shows a simplified front view of air-straightening air-guiding automated flapper with oval and round bell mouth for use with the fume hood of FIG. 1, and part of the housing of the fume hood of FIG. 1.
Figure 7:
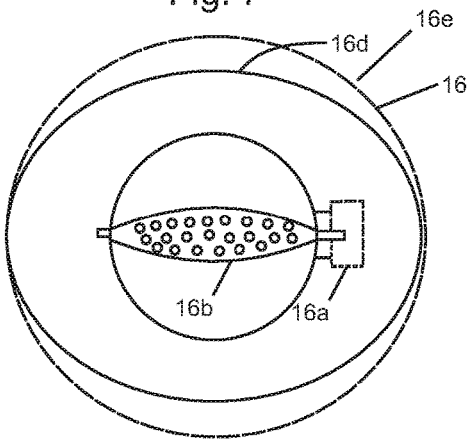
FIG. 7 shows a simplified bottom view of the air-straightening air-guiding automated flapper with oval and round bell mouth of FIG. 6, and a part of the housing of the fume hood of FIG. 1.
Figure 8A:
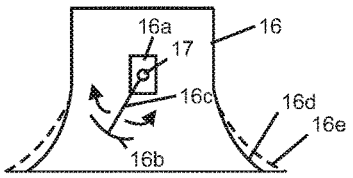
FIG. 8A shows a simplified side view of the air-straightening air-guiding automated flapper with oval and round bell mouth of FIG. 6, and a part of the housing of the fume hood of FIG. 1, with the flapper in a first state, wherein a pivot blade and teeth of the flapper have been rotated or pivoted to the left
Figure 8B:
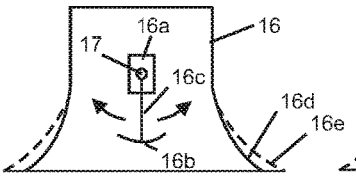
FIG. 8B shows the simplified side view as in FIG. 8A, but with the flapper in a second state, wherein a pivot blade and teeth of the flapper have been rotated from the state of FIG. 8A, to a central orientation.
Figure 8C:
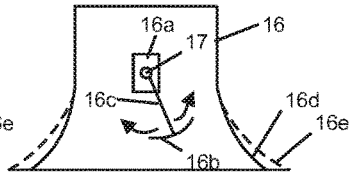
FIG. 8C shows the simplified side view as in FIG. 8B, but with the flapper in a third state, wherein a pivot blade and teeth of the flapper have been rotated from the state of FIG. 8B to being oriented to the right.
Figure 9:
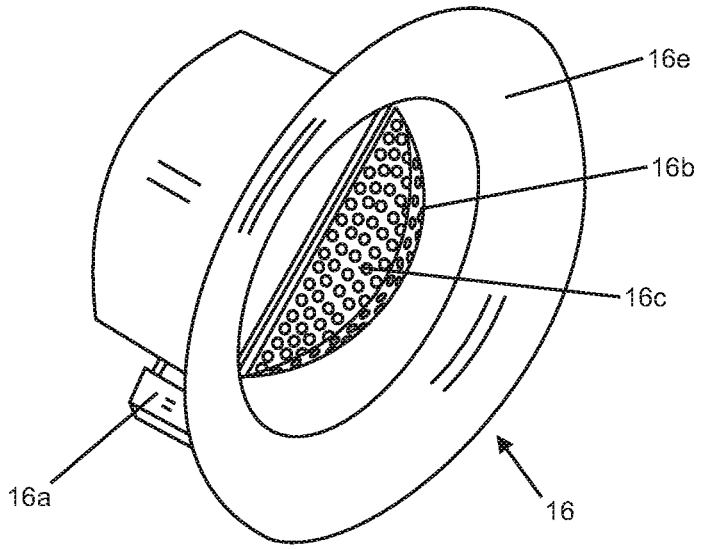
FIG. 9 illustrates a three dimensional view of air-straightening air-guiding automated flapper as a part of a housing of the fume hood of FIG. 1.

FIG. 8A shows a simplified side view of the air-straightening air-guiding automated flapper 16 with oval and round bell mouth of FIG. 6, and a part of the housing of the fume hood 1 of FIG. 1, with the flapper 16 in a first state, such that the blade 16*c* and teeth 16*b* have been rotated or pivoted using pivot pin or shaft 17 of a actuator 16*a*, to the left. FIG. 8B shows the simplified side view as in FIG. 8A, but with the flapper 16 in a second state, wherein the blade 16*c* and teeth 16*b* have been rotated, using pivot pin or shaft 17 of the actuator 16*a*, from the state of FIG. 8A, to a central orientation. FIG. 8C shows the simplified side view as in FIG. 8B, but with the flapper 16 in a third state, wherein the blade 16*c* and teeth 16*b* have been rotated from the state of FIG. 8B to being oriented to the right.

The actuator 16*a* may turn the shaft 17 to cause oscillation or movement of the blade 16*c* and the teeth 16*b* from the state of FIG. 8A to 8B to 8C, then back to 8B and 8A, in a continuous oscillatory, periodic manner, at a particular rate or speed as determined by microcomputer alarm and control unit 18. The rate may be stored in a computer memory of computer or microcomputer alarm and control unit 18.

Figure 10:
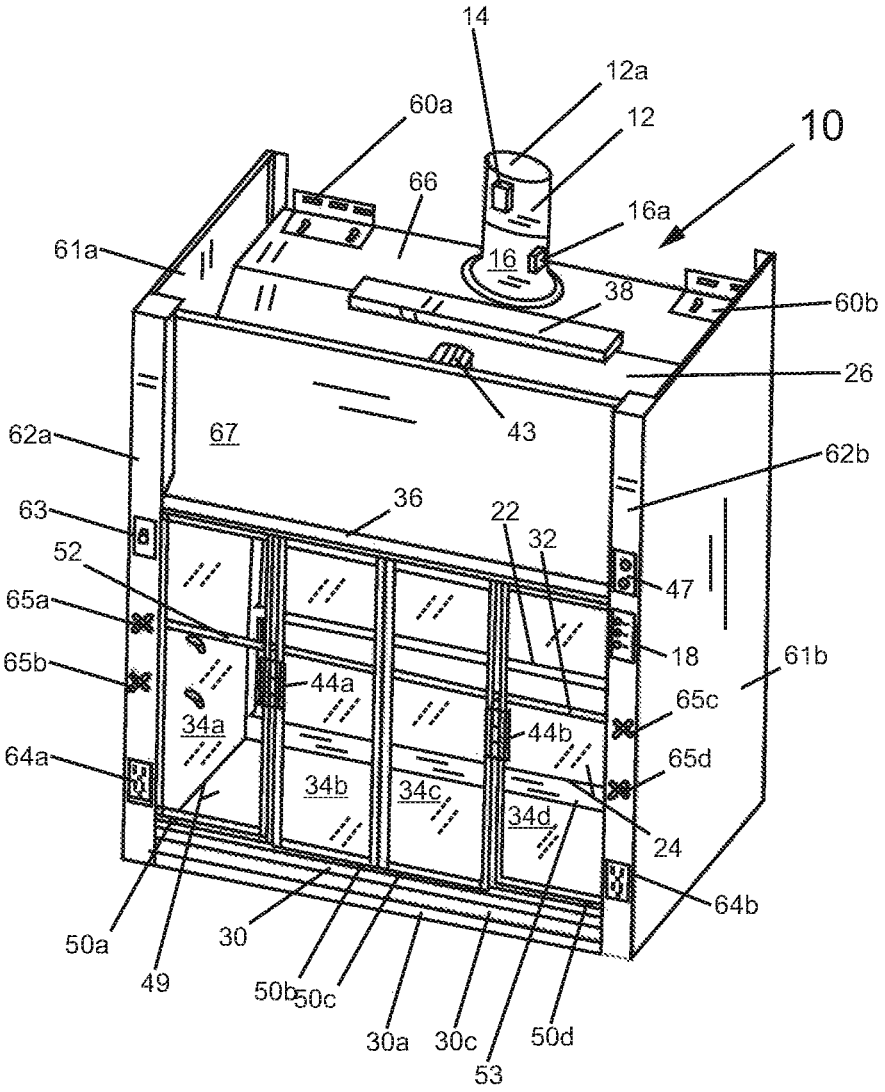
FIG. 10 depicts simplified three-dimensional view of the fume hood of FIG. 1.

FIG. 10 depicts three-dimensional view of the fume hood in FIG. 1. Additional components identified on FIG. 10 (not identified in FIG. 1-9) are common to most known fume hoods. Components 60*a* and 60*b* are wall mounts for installation, 61*a* and 61*b* are exterior side panels, 62*a* and 62*b* are front posts, 63 is a light on/off switch, 64*a* and 64*b* are 120 VAC (volts alternating current) duplex outlets, components 65*a*, 65*b*, 65*c*, 66*d* are utility (gas) service valve handles, component 66 is a fume hood ceiling panel, and component 67 is a top front panel.

Referring to FIGS. 1-10, the fume hood 10 provides an ultra stable vortex for improved containment at low airflow with fixed turning vanes 40*a*, 40*b*, 40*c*, 40*d*, 26 and 28 and automated air-straightening air-guiding flapper 16 and multi-functional airfoil 30 within a fume hood chamber 46 shown in FIGS. 2 and 5. A dual function sensor 20 referred as pressure element (PE) 106, shown in FIGS. 1, 2, and 5 senses total pressure of the vortex in one instance inside of the chamber 46 and provides a signal to a microcomputer alarm and control unit 18, which is comprised of dual function pressure differential transmitter (PdT) 110, dual function pressure differential indicating alarm (PdIA) 112 and dual closed loop pressure differential control (PdC) 108. One output of the dual closed loop control (PdC) 108 modulates air-straightening air-guiding flapper 16 via actuator (M) 102 to direct airflow to slots 51, 52 and 53 of baffles 22 and 24 in order to maintain a ultra stable vortex inside of the inner chamber 46. Loss of ultra stable vortex or total pressure inside of chamber 46 is displayed by a light indication and buzzer sound at the microcomputer alarm and control unit 18. A dual function sensor 20 referred as pressure element (PE) 106, shown in FIGS. 1, 2, and 5 also senses differential pressure in second instance between the chamber 46 and room for face velocity manipulation by providing a signal to microcomputer alarm and control unit 18. A second output of the closed loop control (PdC) 108 of the microcomputer alarm and control unit 18 modulates damper actuator 14 (M 100) automatically to maintain constant face velocity at the window openings. The microcomputer alarm and control unit 18 is configured, in at least one embodiment, to provide dual control signal (i.e. control signal to automated flapper actuator 16*a* referred to M 102 and to VAV (variable air volume) damper actuator 14 referred to M 100).

Fume hood 10 eliminates tough to maintain existing fume hood counter balance weight system for a vertical sash opening. The window system including components 34, 36 and 30 operates by sliding horizontal windowpanes 34*a*, 34*b*, 34*c*, and 34*d*, such as from the position shown in FIG. 1 to the position shown in FIG. 3, swing open window panes with removable hinge mechanisms 44*a* and 44*b* (as shown in FIG. 3) or 50% open windows by sliding left and right and fully opening or closing to eighteen inches (in at least one embodiment) of vertical windowpane 32 with push button hand control 47 referred to HC 114 and actuator 43 referred to M 104 shown in FIG. 1 and FIG. 5, thus providing the ability to have full open sash for loading and unloading. Vertical windowpane 32 can be adjusted from an eighteen inches height D1 for restricted sash opening operation 48 shown in FIG. 3 to a full opening of twenty-eight inches for loading and unloading. In at least one embodiment, the window system including components 34*a-d*, 36, 30, and 32 provides a triple layer of glass for worker safety when windowpane 32 is down and windowpane 32*a* slid behind 32*b* or 32*d* slid behind 34*c*.

The fume hood 10 and/or overall window apparatus and system comprises horizontal gliding and swing open windowpanes 34*a-b*, adjustable vertical opening windowpane 32, gliding tracks 36 and multi-functional airfoil 30. Airfoil 30 combines six important functions: bypass opening, drainage for work surface spills, glider and swing open for horizontal windowpanes, air washes work surface, air washes inner window surface and directs air to form ultra stable vortex.

Typically, most known fume hoods can be converted to ultra stable high performance low airflow fume hood with installation of multiple turning vanes 40*a-d*, 26, 28, automated air-straightening air-guiding flapper 16, and a window apparatus and system including components 34*a-d*, 32, 30, 50*a-d*, 44*a* and 44*b*, and 36.

The fume hood 10 supports both VAV (variable air volume) and CAV (constant air volume) fume hood applications. Damper 12 with actuator 14 regulates the exhaust air volume to maintain constant face velocity at the face opening for VAV (variable air volume) system applications. Damper 12 may be fixed for hard air balancing in CAV system applications.

Fume hood 10 is 20% to 30% lighter than any previously known fume hood with sash counter balance weight system making it easier to transport, install and maintain.

In operation of the apparatus 10, referring to FIG. 2, at all windowpanes closing, the ambient air comes into the inner chamber 46 through the opening between the components 30*c* and 30*b* and the opening between the components 30*b* and 30*a*. Curved components 30*a*, 30*b* and 30*c* allow the airflow to be directed towards inner surface of the windows 34*a*, 34*b*, 34*c*, and 34*d*, and along the work surface 49 to air wash the inner surfaces of windows 34*a-d* and work surface 49 This air flow through the opening between component 30*c* and 30*b* and the opening between the component 30*b* and 30*a* also functions as bypass and work surface spill drainage channel. When the windows 34*a*, 34*b*, 34*c*, and 34*d* are in open state, curved components 30*a*, 30*b* and 30*c* allow the airflow in the inner chamber 46 to strengthen a vortex formation inside fume hood inner chamber 46. Component 30*b* is connected to 30*a* and 30*c*, through walls or members, such as side walls or members 62*a* and 62*b*, and 61*a* and 61*b* shown in FIG. 10, but FIGS. 2, 4, and 5 are simplified to show air flow.

The sensor 20 senses the total pressure of the inner chamber 46 in one instance and differential pressure between inner chamber and the room ambient air in second instance simultaneously and sends a signal to the to the microcomputer alarm and control unit 18. Based on that total pressure signal the computer 18 controls the rate at which the flapper blade 16*c* and teeth 16*b* oscillates from the state of FIG. 8A to 8B to 8C and back to control the direction of air flow from baffle slots 51, 52 and 53, and out of the exhaust opening 12*a* of the apparatus 10, shown in FIG. 10. In at least one embodiment, this method and apparatus maintains ultra stable vortex inside fume hood chamber 46. In addition the microprocessor or computer 18 is configured to control the damper 12 based on the differential pressure between the ambient air just outside and/or adjacent to the walls of the inner chamber 46 and the pressure inside the inner chamber 46 to maintain constant face velocity at the window opening.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising a sensor configured to sense simultaneously total pressure within an inner chamber of a housing, and differential pressure between the inner chamber of the housing and outside of the housing;

a computer processor which is configured to receive a signal from the sensor based on the total pressure and the differential pressure;

a flapper connected to the housing adjacent to an exhaust opening of the housing, at least partially residing in a bell mouth of the housing leading to the exhaust opening wherein the flapper has a blade having a plurality of openings, and teeth having a plurality of openings;

a shaft;

wherein the blade of the flapper extends from the shaft into the bell mouth of the housing;

a damper connected to housing at the exhaust opening of the housing, closer to the exhaust opening than the flapper, and outside of the bell mouth of the housing, wherein the damper regulates the amount of air escaping from the inner chamber of the housing through the exhaust opening;

and wherein the computer processor is programmed by computer software stored in computer memory to control a rate at which the blade of the flapper oscillates, in response to rotation of the shaft, wherein a first end of the blade is fixed to the shaft while a second end of the blade, opposite the first end, moves freely, based on the total pressure signal from the sensor, to thereby control the direction of the flow of air from the inner chamber of the housing through the plurality of openings of the blade, through the plurality of openings of the teeth, and the computer processor also controls a rate at which the damper regulates the amount of air flow based on differential pressure signal from the sensor, to thereby maintain constant face velocity at the window opening, and out the exhaust opening of the housing.

2. The apparatus of claim 1 wherein one or more baffles with turning vanes are fixed to the housing, inside the inner chamber, and each of the one or more baffles includes one or more slots through which air flows inside of the inner chamber.

3. The apparatus of claim 2 further comprising a turning vane fixed to one of the one or more baffles inside of the inner chamber, adjacent to a slot opening of the one or more baffles.

4. The apparatus of claim 1 wherein the computer processor is programmed by computer software stored in computer memory to control the damper which regulates the amount of air flow from the inner chamber escaping through the exhaust opening.

5. The apparatus of claim 1 wherein the blade is shaped in the form of a half circle having a straight edge and an arc edge;

and wherein the straight edge of the blade is fixed to and parallel to the shaft, while the arc edge is free, so that when the shaft rotates the straight edge remains fixed to the shaft and the arc edge moves freely about the shaft.

6. A method comprising sensing total pressure within an inner chamber of a housing, and sensing differential pressure between the inner chamber of the housing and work area outside of the housing using a sensor;

using a computer processor to receive a signal from the sensor based on total pressure and the differential pressure;

using the computer processor to control the rate at which a flapper oscillates based on the signal from the sensor, to thereby control direction of flow of air from the inner chamber of the housing through a plurality of openings of a blade of the flapper, and through a plurality of openings of teeth of the flapper, and out an exhaust opening of the housing, and using the computer processor to control the rate at which a damper modulates air flow escaping from the inner chamber of the housing, through a bell mouth of the housing leading to the exhaust opening, and through the exhaust opening based on the signal from the sensor, to thereby regulate the flow of air from the inner chamber of the housing, and out an exhaust opening of the housing; and wherein the flapper is at least partially located in the bell mouth of the housing.

7. The apparatus of claim 6 wherein the blade is shaped in the form of a half circle having a straight edge and an arc edge;

wherein the straight edge of the blade is fixed to and parallel to a shaft, while the arc edge is free, so that when the shaft rotates the straight edge remains fixed to the shaft and the arc edge moves freely about the shaft.

* * * * *